US009700925B2

(12) United States Patent
Shatermashhadi et al.

(10) Patent No.: US 9,700,925 B2
(45) Date of Patent: Jul. 11, 2017

(54) SYSTEM AND METHOD FOR HYDROSTATIC BACKWARD EXTRUSION

(71) Applicants: Vahid Shatermashhadi, Tehran (IR); Babak Manafi, Tehran (IR); Karen Abrinia, Tehran (IR)

(72) Inventors: Vahid Shatermashhadi, Tehran (IR); Babak Manafi, Tehran (IR); Karen Abrinia, Tehran (IR)

( * ) Notice: Subject to any disclaimer, the term of this patent is extended or adjusted under 35 U.S.C. 154(b) by 0 days.

(21) Appl. No.: 14/932,809

(22) Filed: Nov. 4, 2015

(65) Prior Publication Data

US 2016/0052035 A1 Feb. 25, 2016

(51) Int. Cl.

| | |
|---|---|
| ***B21C 23/00*** | (2006.01) |
| ***B21C 23/32*** | (2006.01) |
| ***B21C 23/18*** | (2006.01) |
| *B21C 23/20* | (2006.01) |

(52) U.S. Cl.

CPC ..... *B21C 23/007* (2013.01); *B21C 23/186* (2013.01); *B21C 23/20* (2013.01)

(58) Field of Classification Search

CPC ..... B21C 23/00; B21C 23/007; B21C 23/18; B21C 23/186; B21C 23/20; B21C 23/205; B21C 23/21; B21C 23/212; B21C 23/217; B21C 23/218

USPC ... 72/54, 60, 264, 265, 266, 267, 273.5, 711

See application file for complete search history.

(56) References Cited

U.S. PATENT DOCUMENTS

| | | | | |
|---|---|---|---|---|
| 3,751,955 | A * | 8/1973 | Stromblad | B21C 31/00 72/60 |
| 3,851,511 | A * | 12/1974 | Aberg | B21C 23/007 72/60 |
| 3,967,485 | A * | 7/1976 | Oguchi | B21C 26/00 72/271 |
| 4,876,868 | A * | 10/1989 | Tushaus | B21C 23/32 72/267 |

* cited by examiner

*Primary Examiner* — Peter DungBa Vo
*Assistant Examiner* — Joshua D Anderson
(74) *Attorney, Agent, or Firm* — Barry Choobin; Patent 360

(57) ABSTRACT

The embodiments herein provide a hydrostatic backward extrusion system that utilizes hydrostatic pressure to produce products with desired cross sectional profile based on backward extrusion process. The system comprises a container, a plunger, fixed-punch, and a billet chamber. The billet material is placed inside the billet chamber. The empty space between the billet chamber and the billet material is filled with a high pressure fluid. Sealing is done at appropriate places to prevent leakage of fluid during the extrusion process. The plunger is moved down to create pressure on the fluid. Due to hydrostatic pressure, the billet material flows into the annular space between the container and the fix-punch. The design of head profile, inner and outer radius of fix-punch allows the billet material to flow smoothly into the annular and forms an extruded product.

10 Claims, 18 Drawing Sheets

SYSTEM AND METHOD FOR HYDROSTATIC BACKWARD EXTRUSION

SPONSORSHIP STATEMENT

This application is financially sponsored for international filing by the IRANIAN NATIONAL SCIENCE FOUNDATION (INSF).

BACKGROUND

Technical Field

The embodiments herein are generally related to extrusion technology. The embodiments herein are particularly related to a backward extrusion system that requires lower extrusion loads to produce products with higher mechanical strength. The embodiments herein are more particularly related a hydrostatic backward extrusion system that utilizes hydrostatic pressure to produce products with desired cross sectional profile based on backward extrusion process.

Description of the Related Art

Extrusion is a process used to create objects of fixed cross-sectional profile. In extrusion, a material of certain length and cross section is forced to flow through a die of a smaller cross sectional area to create a fixed cross-sectional profile of the material. The length of the extruded part is varied based on the amount of material in the work piece and the profile extruded. For example, a round billet is forced through a die opening creating a round part of reduced diameter. The cross section produced uniforms over the entire length of the metal extrusion.

The extrusion process is capable of creating tremendous amounts of geometric change and deformation of the work piece when compared with other metal forming processes. Metal extrusion in manufacturing industry is classified into two main categories such as direct or forward extrusion and indirect or backward extrusion. The conventional backward extrusion is well known in the manufacturing industries and is considered as the best method for producing the cylindrical or end-tube kind of products.

In the conventional backward extrusion process, the extrusion load required for using high extrusion ratio or materials with high mechanical strength, is high. As a result, the products that are created using the backward extrusion process always require high extrusion loads especially for the products with very thin thickness and higher mechanical strength. The conventional backward extrusion process limits the production of parts with longer length because of punch deflection and friction problems. Also, the conventional hydrostatic extrusion systems are not used to produce close-end tubes.

Further, in the conventional extrusion process, the friction between the billet and container is increased due to the increase of the contact surface (billet/container), when a billet with long length is used in the billet chamber. Due to longer length of billet, the friction between the billet and fix-punch also increases. This problem causes many disadvantages such as higher extrusion load. Also, the length of moveable punch increases with increase in the length of billet. Further, the usage of billet with smaller diameter increases the buckling problem of the moveable punch.

Hence, there is a need for a hydrostatic backward extrusion system that utilizes hydrostatic pressure to produce products with a desired cross sectional profile based on backward extrusion process. Further, there is a need for a hydrostatic backward extrusion system that requires lower extrusion loads to produce products with higher mechanical strength. Furthermore, there is a need for a hydrostatic backward extrusion system that enhances mechanical properties of a product by imposing higher effective plastic strain on the product. There is also a need for a hydrostatic backward extrusion system that produces products with long length by reducing punch deflection problems.

The above mentioned shortcomings, disadvantages and problems are addressed herein and which will be understood by reading and studying the following specification.

OBJECT OF THE EMBODIMENTS

The primary object of the embodiments herein is to provide a hydrostatic backward extrusion system that utilizes a hydrostatic pressure to produce a product with desired cross sectional profile based on a backward extrusion process.

Another object of the embodiments herein is to provide a hydrostatic backward extrusion system that requires a lower extrusion loads to produce a product with a higher mechanical strength.

Yet another object of the embodiments herein is to provide a hydrostatic backward extrusion system that enhances the mechanical properties of a product by imposing a higher effective plastic strain on the product.

Yet another object of the embodiments herein is to provide a hydrostatic backward extrusion system that produces a product with a longer length by reducing the punch deflection problems.

Yet another object of the embodiments herein is to provide a hydrostatic backward extrusion system that eliminates a friction between the various components present in the extrusion system.

Yet another object of the embodiments herein is to provide a hydrostatic backward extrusion system that produces an ultra-fine grained close end tubes.

These and other objects and advantages of the embodiments herein will become readily apparent from the following detailed description taken in conjunction with the accompanying drawings.

SUMMARY

The following details present a simplified summary of the embodiments herein to provide a basic understanding of some aspects of the embodiments herein. This summary is not an extensive overview of the embodiments herein. It is not intended to identify key/critical elements of the embodiments herein or to delineate the scope of the embodiments herein. Its sole purpose is to present the concepts of the embodiments herein in a simplified form as a prelude to the more detailed description that is presented later.

The other objects and advantages of the embodiments herein will become readily apparent from the following description taken in conjunction with the accompanying drawings.

According to an embodiment herein, a hydrostatic backward extrusion system is provided. The system comprises a container. A fixed-punch is arranged inside the container. The fixed punch comprises a billet chamber to house a billet material. The fixed-punch is placed inside the container to form a gap between the fixed-punch and the container to form a die. The billet material placed inside the billet chamber is surrounded by a fluid. A plunger is placed at a top of the billet chamber.

A first sealing location is provided between the plunger and the fixed-punch to prevent a leakage of the fluid from the billet chamber. A diameter of the billet chamber in the first sealing location is larger than a diameter of the billet material. A second sealing location is arranged at a bottom of the fixed-punch between the billet material and the surrounding fluid to prevent a leakage of the fluid during an extrusion process. A diameter of the billet chamber in the second sealing location is smaller than the diameter of the billet material.

According to an embodiment herein, the plunger is moved forward in the billet chamber to generate a hydrostatic pressure on the fluid. The generated hydrostatic pressure forces the billet material to flow into the gap between the container and the fixed-punch.

According to an embodiment herein, the fixed punch has a head profile and the head profile of the fixed-punch is arranged round in shape. The head profile of the fixed-punch is designed to allow the billet material to flow into the gap between the fixed punch and the container.

According to an embodiment herein, the surrounding fluid prevents a contact of the billet material with the fixed-punch inside the billet chamber.

According to an embodiment herein, the system further comprises a plurality of O-rings provided in the first sealing location to seal the plunger with the fixed-punch.

According to an embodiment herein, an optimum diameter value of the billet chamber is estimated using a finite element analysis.

According to an embodiment herein, the diameter value of the plunger is selected to move the plunger in the billet chamber to produce an extruded product with a desired length.

According to an embodiment herein, the fluid filled in the billet chamber is castor oil.

According to an embodiment herein, the container has an edge with a preset height. The preset edge height of the container is selected such that an edge height of the fixed-punch and the edge height of the container are positioned in front of each other at a same level.

According to an embodiment herein, the extruded product has homogenous properties in nature.

According to an embodiment herein, a method is provided for producing an extruded product using a hydrostatic backward extrusion system comprising a container housing a fixed-punch and a plunger. The method comprising steps of creating a hydrostatic pressure on a fluid placed inside a billet chamber arranged inside the fixed-punch using the plunger; compressing a billet material provided inside the billet chamber against a container using the created hydrostatic pressure; and forcing the billet material to flow into a gap between a fix-punch and the container thereby forming an extruded product.

According to an embodiment herein, the plunger is moved forward in the billet chamber to generate a hydrostatic pressure on the fluid, and the generated hydrostatic pressure forces the billet material to flow into the gap between the container and the fixed-punch.

According to an embodiment herein, the fixed punch is designed to have a head profile and the head profile of the fixed-punch is arranged round in shape. The head profile of the fixed-punch allows the billet material to flow into the gap between the fixed punch and the container.

According to an embodiment herein, the surrounding fluid prevents a contact of the billet material with the fixed-punch inside the billet chamber.

According to an embodiment herein, the method further comprises providing a plurality of O-rings in the first sealing location to seal the plunger with the fixed-punch.

According to an embodiment herein, the method further comprises estimating an optimum diameter value of the billet chamber using a finite element analysis.

According to an embodiment herein, the method further comprises selecting a diameter value of the plunger to move the plunger in the billet chamber to produce an extruded product with a desired length.

According to an embodiment herein, the fluid filled in the billet chamber is castor oil.

According to an embodiment herein, the method further comprises designing an edge of to have a preset height, and wherein the preset height of the edge of the container is designed such that an edge height of the fixed-punch and the edge height of the container are positioned in front of each other at a same level.

According to an embodiment herein, the extruded product has homogenous properties in nature.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The other objects, features and advantages will occur to those skilled in the art from the following description of the preferred embodiment and the accompanying drawings in which.

Figure 1A:
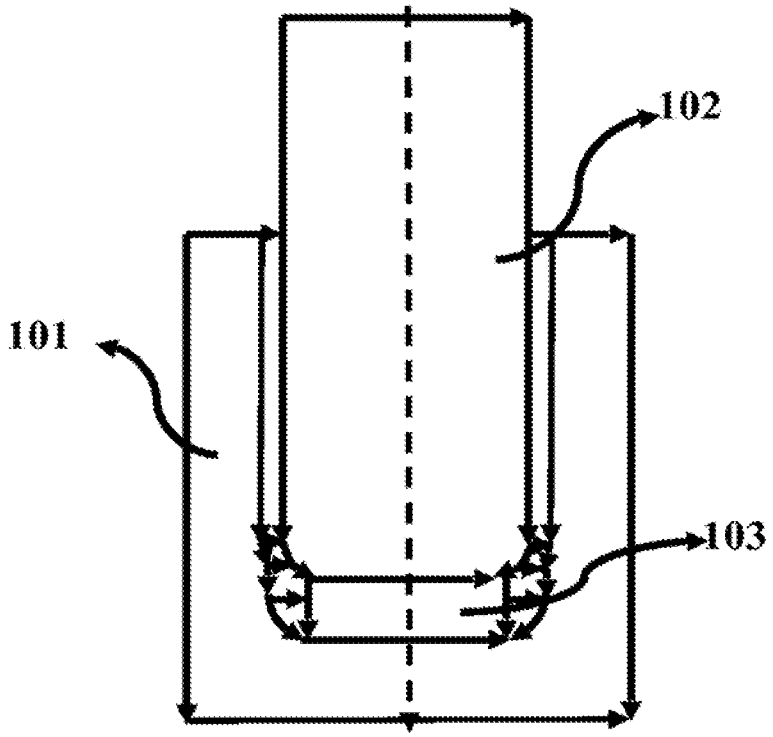
FIG. 1a (PRIOR ART)
FIG. 1*a* illustrates a side sectional view of a conventional backward extrusion system in a prior art.

Although the specific features of the embodiments herein are shown in some drawings and not in others. This is done for convenience only as each feature may be combined with any or all of the other features in accordance with the embodiment herein.

DETAILED DESCRIPTION OF THE EMBODIMENTS

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

In the following detailed description, a reference is made to the accompanying drawings that form a part hereof, and in which the specific embodiments that may be practiced is shown by way of illustration. The embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

According to an embodiment herein, a hydrostatic backward extrusion system is provided. The system comprises a container. A fixed-punch is arranged inside the container. The fixed punch comprises a billet chamber to house a billet material. The fixed-punch is placed inside the container to form a gap between the fixed-punch and the container to form a die. The billet material placed inside the billet chamber is surrounded by a fluid. A plunger is placed at a top of the billet chamber.

A first sealing location is provided between the plunger and the fixed-punch to prevent a leakage of the fluid from the billet chamber. A diameter of the billet chamber in the first sealing location is larger than a diameter of the billet material. A second sealing location is arranged at a bottom of the fixed-punch between the billet material and the surrounding fluid to prevent a leakage of the fluid during an extrusion process. A diameter of the billet chamber in the second sealing location is smaller than the diameter of the billet material.

According to an embodiment herein, the plunger is moved forward in the billet chamber to generate a hydrostatic pressure on the fluid. The generated hydrostatic pressure forces the billet material to flow into the gap between the container and the fixed-punch.

According to an embodiment herein, the fixed punch has a head profile and the head profile of the fixed-punch is arranged round in shape. The head profile of the fixed-punch is designed to allow the billet material to flow into the gap between the fixed punch and the container.

According to an embodiment herein, the surrounding fluid prevents a contact of the billet material with the fixed-punch inside the billet chamber.

According to an embodiment herein, the system further comprises a plurality of O-rings provided in the first sealing location to seal the plunger with the fixed-punch.

According to an embodiment herein, an optimum diameter value of the billet chamber is estimated using a finite element analysis.

According to an embodiment herein, the diameter value of the plunger is selected to move the plunger in the billet chamber to produce an extruded product with a desired length.

According to an embodiment herein, the fluid filled in the billet chamber is castor oil.

According to an embodiment herein, the container has an edge with a preset height. The preset edge height of the container is selected such that an edge height of the fixed-punch and the edge height of the container are positioned in front of each other at a same level.

According to an embodiment herein, the extruded product has homogenous properties in nature.

According to an embodiment herein, a method is provided for producing an extruded product using a hydrostatic backward extrusion system comprising a container housing a fixed-punch and a plunger. The method comprising steps of creating a hydrostatic pressure on a fluid placed inside a billet chamber arranged inside the fixed-punch using the plunger; compressing a billet material provided inside the billet chamber against a container using the created hydrostatic pressure; and forcing the billet material to flow into a gap between a fix-punch and the container thereby forming an extruded product.

According to an embodiment herein, the plunger is moved forward in the billet chamber to generate a hydrostatic pressure on the fluid, and the generated hydrostatic pressure forces the billet material to flow into the gap between the container and the fixed-punch.

According to an embodiment herein, the fixed punch is designed to have a head profile and the head profile of the fixed-punch is arranged round in shape. The head profile of the fixed-punch allows the billet material to flow into the gap between the fixed punch and the container.

According to an embodiment herein, the surrounding fluid prevents a contact of the billet material with the fixed-punch inside the billet chamber.

According to an embodiment herein, the method further comprises providing a plurality of O-rings in the first sealing location to seal the plunger with the fixed-punch.

According to an embodiment herein, the method further comprises estimating an optimum diameter value of the billet chamber using a finite element analysis.

According to an embodiment herein, the method further comprises selecting a diameter value of the plunger to move the plunger in the billet chamber to produce an extruded product with a desired length.

According to an embodiment herein, the fluid filled in the billet chamber is castor oil.

According to an embodiment herein, the method further comprises designing an edge of to have a preset height, and wherein the preset height of the edge of the container is designed such that an edge height of the fixed-punch and the edge height of the container are positioned in front of each other at a same level.

According to an embodiment herein, the extruded product has homogenous properties in nature.

The embodiments herein provides a hydrostatic backward extrusion system that utilizes hydrostatic pressure to produce products with desired cross sectional profile based on backward extrusion process. The hydrostatic backward extrusion system comprises a container, a fix-punch, a billet chamber, a billet material, a plunger, O-rings, a first sealing location, a second sealing location, and a high pressure fluid.

According to an embodiment herein, a chamber is designed in the fix-punch to place the billet material. The fix-punch is placed inside the container. The inner diameter of the billet chamber is considered more than the billet diameter at the top portion of the billet chamber. The empty space between the billet chamber and the billet material is filled with the high pressure fluid. The high pressure fluid prevents the contact of billet material with the fix-punch or die. Due to this, the friction between the billet material and the fix-punch is decreased. Further, the pressure required for producing the extruded product is decreased when compared with the pressure required in the conventional backward extrusion systems.

According to an embodiment herein, the first sealing location is considered between the plunger and the fix-punch to prevent leakage of the fluid due to existence of high pressures in the extrusion process. A pair of O-rings are used to provide seal in the first sealing location.

According to an embodiment herein, in the bottom of the fix-punch the second sealing location is considered between the billet and the surrounded high pressure fluid to prevent the leakage of the high pressure fluid during the extrusion process. At the second sealing location, the diameter of the billet chamber is smaller than the diameter of the billet.

According to an embodiment herein, when the billet chamber diameter is less than the optimal value, the extrusion pressure rises rapidly in the system. When the billet chamber diameter is more than the optimal value, pressure forming rises inside the billet chamber and functionality of the seal components fail during the operation. Hence, the diameter value of billet chamber in the second sealing location is selected such that the demanded extrusion pressure doesn't increase above an optimum value. The optimum diameter value of the billet chamber is obtained implementing suitable numerical methods such as a finite element analysis.

According to an embodiment herein, the diameter of the billet chamber in the second sealing location is 18 mm when the diameter of applied billet material is 20 mm.

According to an embodiment herein, the plunger is moved down to create pressure on the high pressure fluid. Due to hydrostatic pressure, the billet material flows into the annular space between the container and the fix-punch.

According to an embodiment herein, when compared with conventional backward extrusion systems, the cross sectional area of the billet material is reduced in the hydrostatic backward extrusion system. The force required to extrude the billet with smaller cross section is less when compared with a billet with larger cross section. Thus, at a constant pressure, force required to extrude the billet in the hydrostatic backward extrusion system is less when compared with the force required to extrude a billet in conventional backward extrusion systems.

According to an embodiment herein, the parameters of the fix-punch comprises an inner radius, an outer radius and an edge height of the fix-punch. The parameters of container comprises radius and an edge height of the container.

According to an embodiment herein, the edge height of container is selected such that the edge height of the fix-punch and the container are positioned front of each other in the same level. When the billet material passes through the annular space between the edge height of container and fix-punch, the contact between the billet material and both sides of the annular space is eliminated. As a result, the friction between the billet material and the system components is negligible.

According to an embodiment herein, the inner radius of the fix-punch allows the billet material to flow smoothly into the annular space between the fix-punch and the container. The outer radius of the fix-punch and the radius of the container improves the flow of billet material during the hydrostatic extrusion process.

According to an embodiment herein, when the value of the inner radius and outer radius of the fix-punch is high, the extrusion pressure required in the hydrostatic extrusion system is reduced when compared with the conventional hydrostatic extrusion systems.

According to an embodiment herein, the speed of the extrusion process in the hydrostatic extrusion system depends on the diameter of the upper part of the fix-punch (the fluid chamber) which is connected to the plunger. Further, the speed of the extrusion process has strong impact on the mechanical properties of the final product.

According to an embodiment herein, the inner and outer of the fix-punch are designed such that appropriate material flow and extrusion pressure is obtained in the hydrostatic extrusion system.

According to an embodiment herein, the radius and edge height of the container 301 are selected such that the required extrusion pressure in the hydrostatic backward extrusion is reduced. The influence of the radius and edge height of the container on the required extrusion pressure is very low when compared with the influence of the fix-punch parameters.

According to an embodiment herein, the radius of the container 301 and the outer radius of fix-punch is same in the hydrostatic backward extrusion system.

According to an embodiment herein, the high pressure fluid used in the hydrostatic backward extrusion system is castor oil and the fluid is functional at very high pressures.

According to an embodiment herein, by using the high pressure fluid instead of a moveable punch, the hydrostatic backward extrusion system eliminates buckling problems of the plunger and the friction between the die components and billet material.

According to an embodiment herein, the hydrostatic backward extrusion system imposes higher plastic strain on final products when compared with conventional hydrostatic and backward extrusion systems.

According to an embodiment herein, the dimensions of the billet chamber in the hydrostatic backward extrusion system is designed such that the speed of extrusion process increases and results in better mechanical properties of the final products.

According to an embodiment herein, the diameter of the plunger is selected such that small movements of the plunger in the billet chamber produces products with desired length.

According to an embodiment herein, the properties of the final product produced from the hydrostatic backward extrusion system are homogenous in nature when compared with the products produced by the conventional hydrostatic and backward extrusion systems.

According to an embodiment herein, the fluid surrounded the billet eliminates the contact between the billet and the container. As a result, the billet material with higher length is used in the hydrostatic backward extrusion system.

According to an embodiment herein, the hydrostatic pressure created in the hydrostatic backward extrusion system improves homogeneity of the final extruded products. Further, the final extruded products has little defects (especially defects that are related to the anisotropic flow of material into the die such as unparalleled edge of produced tube) and the sound length of final extruded products is high and the unproduced tube does not need to be cut after the process.

According to an embodiment herein, the hydrostatic backward extrusion is utilized to produce ultra-fine grained close end tubes which are not possible to produce with hydrostatic extrusion process.

According to an embodiment herein, the hydrostatic backward extrusion system requires very lower load in comparison with conventional hydrostatic extrusion or simple backward extrusion.

FIG. 1*a* illustrates a side sectional view of a conventional backward extrusion system in a prior art. With respect to FIG. 1, the conventional backward extrusion system comprises container 101, punch 102, and billet 103. The container 101 is completely closed off at one end. The billet 103 is placed inside the container 101. The punch 102 is placed on the billet 103 and is forced into the billet 103. There is no relative motion between the container 101 and the billet 103. As the manufacturing process proceeds, the billet 103 flows into an annular space between the container 101 and the punch 102 and forms an extruded product.

Figure 1B:
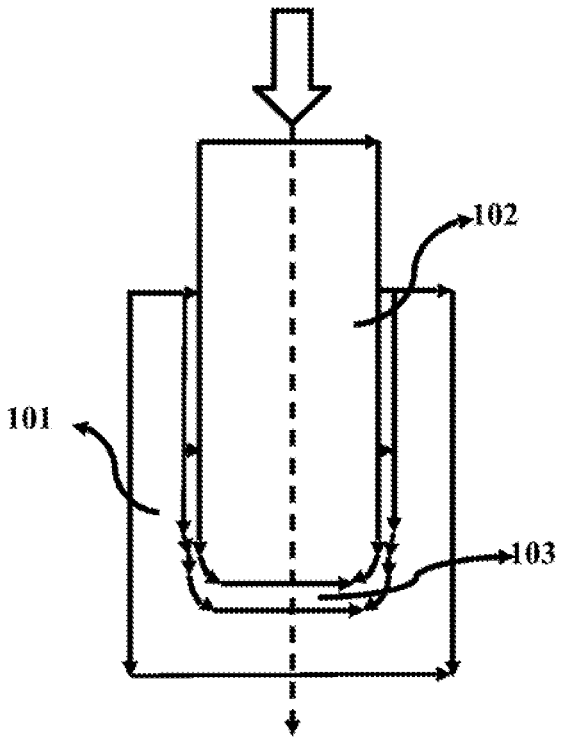
FIG. 1b (PRIOR ART)
FIG. 1*b* illustrates a side sectional view of a conventional backward extrusion system while compressing a billet in a prior art.

FIG. 1*b* illustrates a side sectional view of a conventional backward extrusion system while compressing a billet in a prior art. With respect to FIG. 1*b*, the punch 102 is placed on the billet 103 and is forced into the billet 103. The punch 102 compresses the billet 103 against the container 101 and forces the billet 103 to flow into an annular space between the punch 102 and the container 101. The billet 103 flows through the annular space in a direction opposite to the punch 102 motion.

Figure 1C:
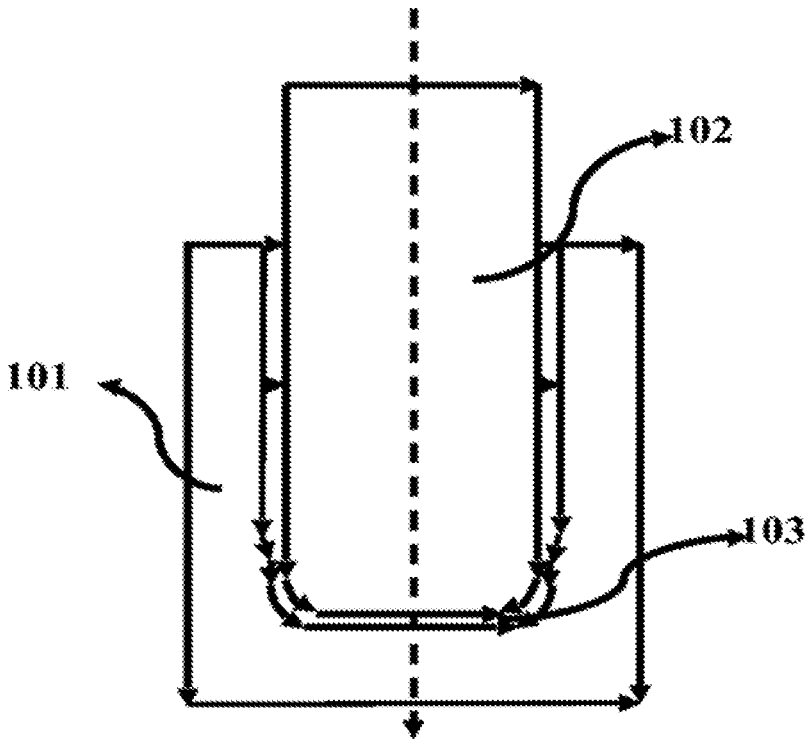
FIG. 1c (PRIOR ART)
FIG. 1*c* illustrates a side sectional view of a conventional backward extrusion system after forming an extruded product in a prior art.

FIG. 1*c* illustrates a side sectional view of a conventional backward extrusion system after forming an extruded product in a prior art. With respect to FIG. 1*c*, the punch 102 is forced into the billet 103, to make the billet 103 to flow into the annular space between the container 101 and the punch 102 to form an extruded product. After the manufacturing process, the punch 102 is removed and the extruded product is collected from the container 101.

Figure 2:
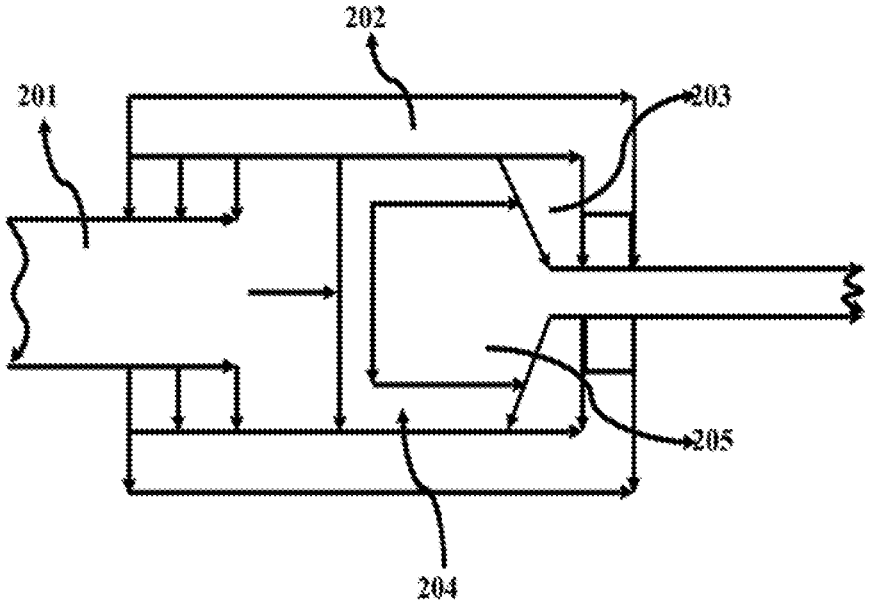
FIG. 2 (PRIOR ART)
FIG. 2 illustrates a side sectional view of a conventional hydrostatic extrusion system in a prior art.

FIG. 2 illustrates a side sectional view of a conventional hydrostatic extrusion system in a prior art. With respect to FIG. 2, the conventional hydrostatic extrusion system comprises plunger (ram) 201, sealed chamber 202, die 203, high pressure fluid 204 and billet 205. The conventional hydrostatic extrusion works based on the forward extrusion technique. The sealed chamber 202 is filled with a high pressure fluid 204. The high pressure fluid 204 surrounds the billet 205 and transmits extrusion pressure to the billet 205. The plunger 201 is placed inside the sealed chamber 202 and moved forward to pressurize the high pressure fluid 205. Due to hydrostatic pressure around the billet 205, the billet 205 is pushed forward into the die 203 and produces an extruded product.

Figure 3A:
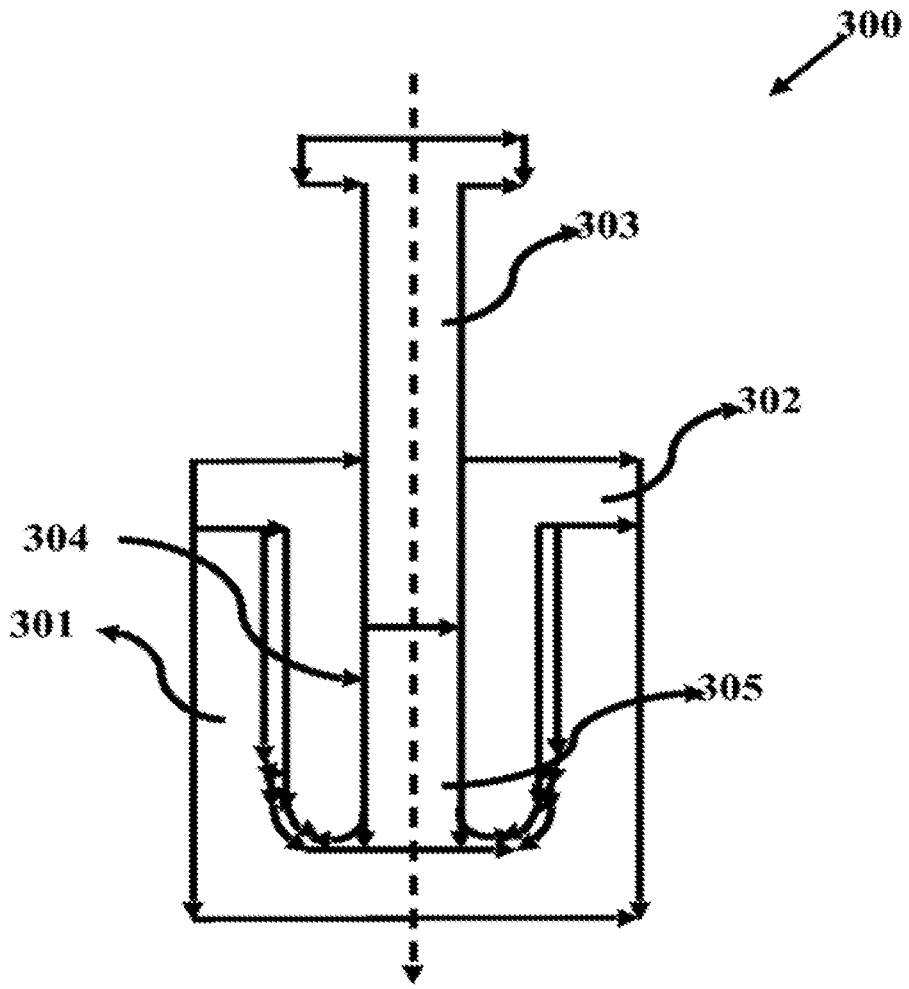
FIG. 3*a* illustrates a side sectional view of a backward extrusion system with reduced billet cross sectional design, according to an embodiment herein.

FIG. 3*a* illustrates a side sectional view of a backward extrusion system with reduced billet cross sectional design, according to an embodiment herein.

FIG. 3*a* illustrates a schematic view of a backward extrusion system with a reduced billet cross sectional area, according to an embodiment herein. With respect to FIG. 3*a*, the backward extrusion system 300 comprises container 301, fix-punch 302, movable punch 303, billet chamber 304, and billet material 305.

According to an embodiment herein, a hole in the fix-punch 302 forms the billet chamber 304. The billet material 305 is placed inside the billet chamber 304. The moveable punch 303 is placed above the billet 305 and is moved in the billet chamber 304. The movable punch 303 compresses the billet 305 against the container 301 and forces the billet 305 to flow into an annular space between the fix-punch 302 and the container 301.

According to an embodiment herein, the cross sectional area of the billet 305 is reduced in the backward extrusion system 300, when compared with conventional backward extrusion systems. Pressure (P) is defined as the force (F) applied perpendicular to the surface of an object per unit area (A) over which that force is distributed.

$$P=F/A \tag{1}$$

From equation (1), it is known that a direct relationship is generated between force (F) and cross section (A) of an object at a constant pressure (P). Hence, at a constant pressure (P), a reduction of the cross section (A), reduces the force (F) applied on the object. In the other words, the force (F) required to extrude the billet 305 with a smaller cross section is less when compared with a billet having a larger cross section. Thus, at a constant pressure (P), the force (F) required to extrude the billet 305 in the backward extrusion system 300 is less when compared with the force (F) required to extrude a billet in conventional backward extrusion systems.

According to an embodiment herein, the head profile of the fix-punch 302 is arranged in a round shape. The design of the head profile of the fix-punch 302 allows the billet material to flow smoothly into the annular space between the fixed punch 302 and the container 301.

According to an embodiment herein, the parameters of the fix-punch 302 comprises an inner radius, an outer radius and an edge height of the fix-punch 302. The parameters of container 301 comprises a radius and edge height of the container 301.

According to an embodiment herein, the edge height of the container 301 is designed such that the edge height of the container 301 and the fix-punch 302 are positioned in front of each other at the same level. The movable punch 303 is moved downwards in the billet chamber 304. The pressure exerted by the movable punch 303 forces the billet material 305 to pass through an annular space between the edge height of the container 301 and the fix-punch 302.

According to an embodiment herein, the design of inner radius of the fix-punch 302 allows the billet material 305 to flow through the billet chamber 305 and inside the die. The design of outer radius of the fix-punch 302 and the radius of the container 301 improves the flow of billet material 305 during the backward extrusion process.

According to an embodiment herein, the backward extrusion system 300 imposes higher effective plastic strain to the final extruded product and reduces the problem of punch deflection for producing products with long length.

According to an embodiment herein, due to reduction in the cross sectional area of billet material 305, the total load required for the extrusion process reduces to a quarter of load required for the conventional backward extrusion. Further, the cross section of the billet 305 does not affect the dimensions of the final extruded product.

Figure 3B:
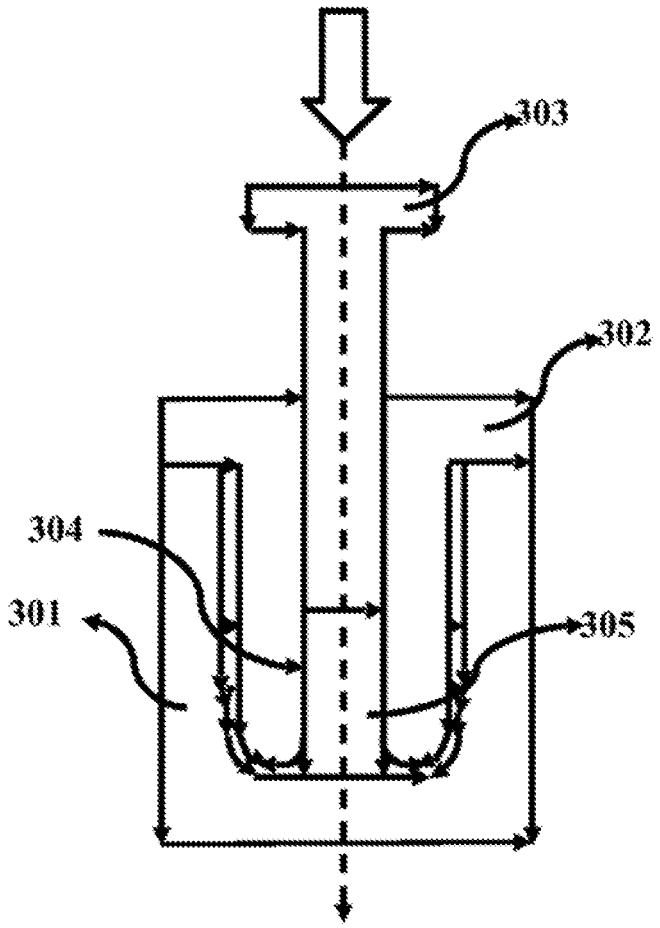
FIG. 3*b* illustrates a side sectional view of a backward extrusion system with reduced billet cross sectional design while compressing the billet, according to an embodiment herein.

FIG. 3*b* illustrates a side sectional view of a backward extrusion system with reduced billet cross sectional design while compressing the billet, according to an embodiment herein. With respect to FIG. 3*b*, the movable-punch 303 is placed in the billet chamber 304 and is forced into the billet material 305. The fix-punch 302 compresses the billet 305 against the container 301 and forces the billet material 305 to flow into an annular space between the height of edge of the fix-punch 302 and the container 301. The billet material 305 flows through the annular space in a direction opposite to the fix-punch 302 and forms an extruded product.

Figure 3C:
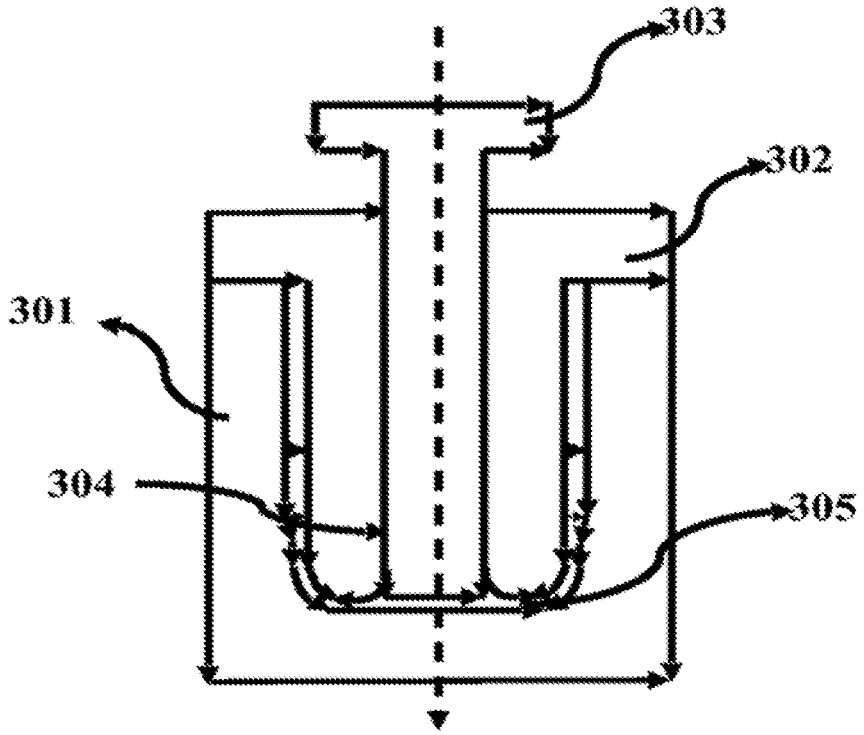
FIG. 3*c* illustrates a side sectional view of a backward extrusion system with reduced billet cross sectional design after forming an extruded product, according to an embodiment herein.

FIG. 3*c* illustrates a side sectional view of a backward extrusion system with reduced billet cross sectional design after forming an extruded product, according to an embodiment herein. With respect to FIG. 3*c*, the billet material 305 flows into the annular space between the height of edge of the fix-punch 302 and the container 301, when the movable-punch 303 is forced into the billet chamber 304. After the manufacturing process, the fix-punch 302 and the movable punch 303 are removed and the extruded product is collected from the container 301.

Figure 4A:
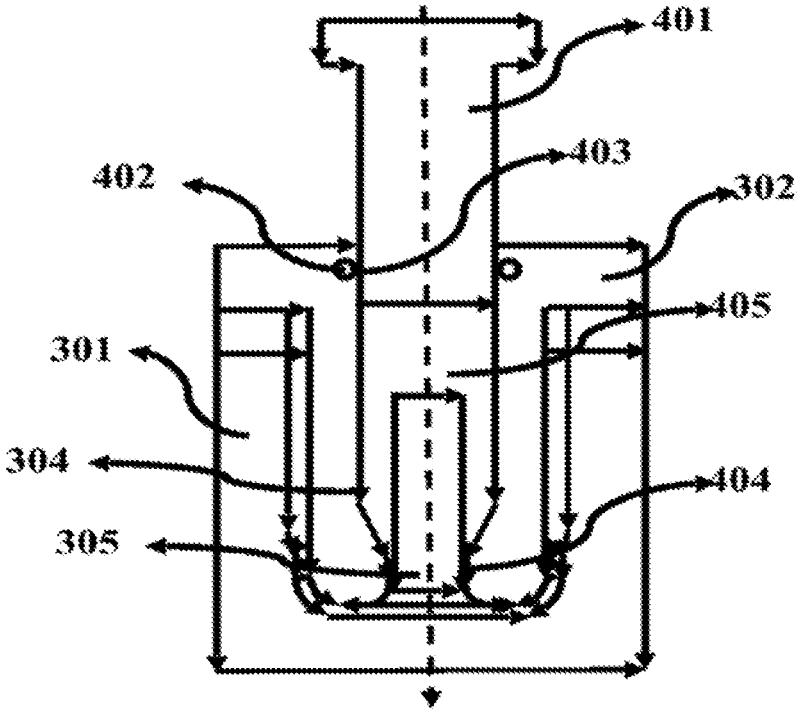
FIG. 4*a* illustrates a side sectional view of a hydrostatic backward extrusion system, according to an embodiment herein.

FIG. 4*a* illustrates a side sectional view of a hydrostatic backward extrusion system, according to an embodiment herein. With respect to FIG. 4*a*, the hydrostatic backward extrusion system comprises container 301, fix-punch 302, billet chamber 304, billet material 305, plunger 401, O-rings 402, first sealing location 403, second sealing location 404, and high pressure fluid 405.

According to an embodiment herein, a chamber 304 is designed in the fix-punch 302 to place the billet material 305. The fix-punch 302 is placed inside the container 301. The inner diameter of the billet chamber 304 is considered more than the billet 305 diameter at the top portion of the billet chamber. The empty space between the billet chamber 304 and the billet material 305 is filled with the high pressure fluid 405. The high pressure fluid 405 prevents the contact of billet material 305 with the fix-punch 302 or die. Due to this, the friction between the billet material 305 and the fix-punch 302 is decreased. Further, the pressure required for producing the extruded product is decreased when compared with the pressure required in the conventional backward extrusion systems.

According to an embodiment herein, the first sealing location 403 is considered between the plunger 401 and the fix-punch 302 to prevent leakage of the fluid 405 due to existence of high pressures in the extrusion process. A pair of O-rings 402 are used to provide seal in the first sealing location 403.

According to an embodiment herein, in the bottom of the fix-punch 302 the second sealing location 404 is considered between the billet 305 and the surrounded high pressure fluid 405 to prevent the leakage of the high pressure fluid 405 during the extrusion process. At the second sealing location 404, the diameter of the billet chamber 304 is smaller than the diameter of the billet 305.

According to an embodiment herein, the extrusion pressure rises rapidly in the system, when the billet chamber 304 diameter is less than the optimal value. When the diameter of the billet chamber 304 is more than the optimal value, the extrusion pressure formed inside the billet chamber 304 rises rapidly and a functionality of the seal components fail during the operation. Hence, the diameter value of billet chamber 304 in the second sealing location 404 is selected such that the demanded extrusion pressure doesn't increase above an optimum value. The optimum diameter value of the billet chamber 304 is obtained by implementing suitable numerical methods such as a finite element analysis.

According to an embodiment herein, the diameter of the billet chamber 304 in the second sealing location 404 is 18 mm, when the diameter of applied billet material 305 is 20 mm.

According to an embodiment herein, the plunger 401 is moved down to create pressure on the high pressure fluid 405. Due to hydrostatic pressure, the billet material 305 flows into the annular space between the container 301 and the fix-punch 302.

According to an embodiment herein, the parameters of the fix-punch 302 comprises an inner radius, an outer radius and an edge height of the fix-punch 302. The parameters of container 301 comprises radius and an edge height of the container 301.

According to an embodiment herein, the edge height of container is selected such that the edge height of the fix-punch 302 and the container 301 are positioned in front of each other at the same level. When the billet material 305 passes through the annular space between the edge height of container 301 and fix-punch, the contact between the billet material 305 and both sides of the annular space is eliminated. As a result, the friction between the billet material 305 and the system components is negligible.

According to an embodiment herein, the inner radius of the fix-punch 302 allows the billet material 305 to flow smoothly into the annular space between the fix-punch 302 and the container 301. The outer radius of the fix-punch 302 and the radius of the container 301 improves the flow of billet material 305 during the hydrostatic extrusion process.

According to an embodiment herein, when the value of the inner radius and outer radius of the fix-punch 302 is high, the extrusion pressure required in the hydrostatic extrusion system is less than that of the conventional hydrostatic extrusion systems.

According to an embodiment herein, the speed of the extrusion process in the hydrostatic extrusion system depends on the diameter of the upper part of the fix-punch 302 (the fluid chamber) which is connected to the plunger 401. Further, the speed of the extrusion process has strong impact on the mechanical properties of the final product.

According to an embodiment herein, the inner and outer of the fix-punch 302 are designed such that appropriate material flow and extrusion pressure is obtained in the hydrostatic extrusion system.

According to an embodiment herein, the radius and edge height of the container 301 are selected such that the required extrusion pressure in the hydrostatic backward extrusion is reduced. The influence of the radius and edge height of the container 301 on the required extrusion pressure is very low, when compared with the influence of the fix-punch parameters.

According to an embodiment herein, the radius of the container 301 and the outer radius of fix-punch 302 is same in the hydrostatic backward extrusion system.

According to an embodiment herein, the high pressure fluid 405 used in the hydrostatic backward extrusion system is castor oil and the fluid 405 is functional at very high pressures.

According to an embodiment herein, the hydrostatic backward extrusion system eliminates buckling problems of the plunger 401 and the friction between the die components and billet material 305 by using the high pressure fluid 405 instead of a moveable punch.

According to an embodiment herein, the hydrostatic backward extrusion system imposes a higher plastic strain on the final products than that of the conventional hydrostatic and backward extrusion systems.

According to an embodiment herein, the dimensions of the billet chamber 304 in the hydrostatic backward extrusion system is designed such that the speed of extrusion process increases and results in better mechanical properties of the final products.

According to an embodiment herein, the diameter of the plunger 401 is selected such that small movements of the plunger 401 in the billet chamber 304 produces the products with desired length.

According to an embodiment herein, the properties of the final product produced from the hydrostatic backward extrusion system are homogenous in nature when compared with the products produced by the conventional hydrostatic and backward extrusion systems.

According to an embodiment herein, the fluid is arranged to surround the billet to eliminate the contact between the billet and the container. As a result, the billet material with higher length is used in the hydrostatic backward extrusion system.

According to an embodiment herein, the hydrostatic pressure created in the hydrostatic backward extrusion system improves a homogeneity of the final extruded products. Further the final extruded products has little (no) defects (especially defects that are related to the anisotropic flow of material into the die such as unparalleled edge of produced tube) and the sound length of final extruded products is high. The system eliminates the need for cutting the unproduced tube after the completion process.

According to an embodiment herein, the hydrostatic backward extrusion is utilized to produce ultra-fine grained closed end tubes which are not produced with hydrostatic extrusion process.

According to an embodiment herein, the hydrostatic backward extrusion system requires very lower load in comparison with conventional hydrostatic extrusion or simple backward extrusion systems.

Figure 4B:
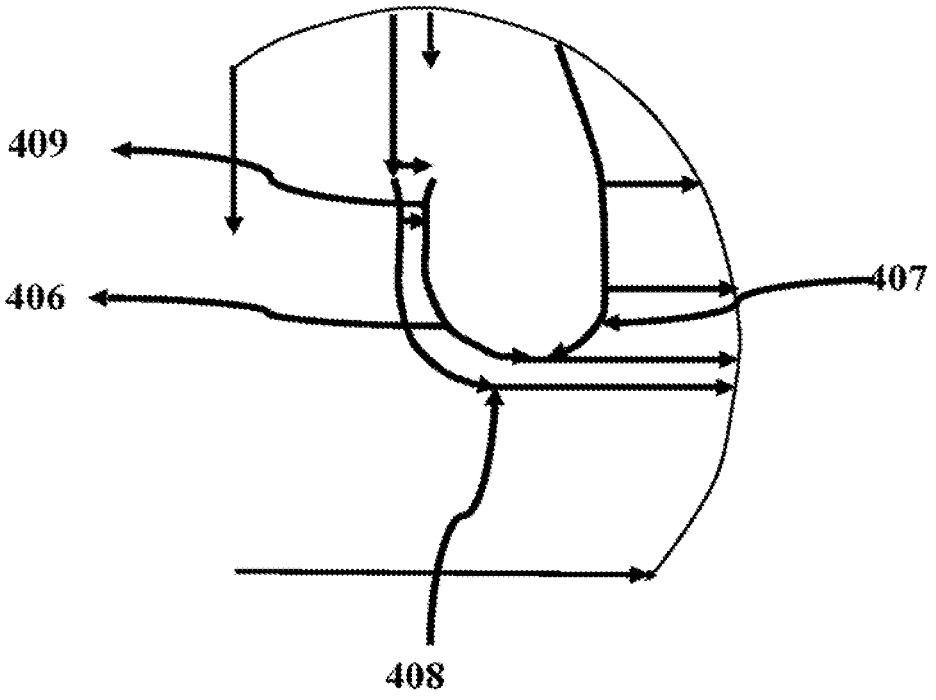
FIG. 4*b* illustrates an enlarged view of a end portion or edge part of a fixed punch in a hydrostatic backward extrusion system, according to an embodiment herein.

FIG. 4*b* illustrates an enlarged view of an end portion or edge part of a fixed punch in a hydrostatic backward extrusion system, according to an embodiment herein. With respect to FIG. 4*b*, the enlarged view of a part of a hydrostatic backward extrusion system comprises edge height of the fix-punch 409, outer radius 406, inner radius 407, and container radius 408. The inner radius 407 of the fix-punch is designed to allow the billet material to flow smoothly into the annular space between the fix-punch and the container. The outer radius 406 of the fix-punch and the container radius 408 are designed to improve the flow of billet material during the hydrostatic extrusion process.

Figure 4C:
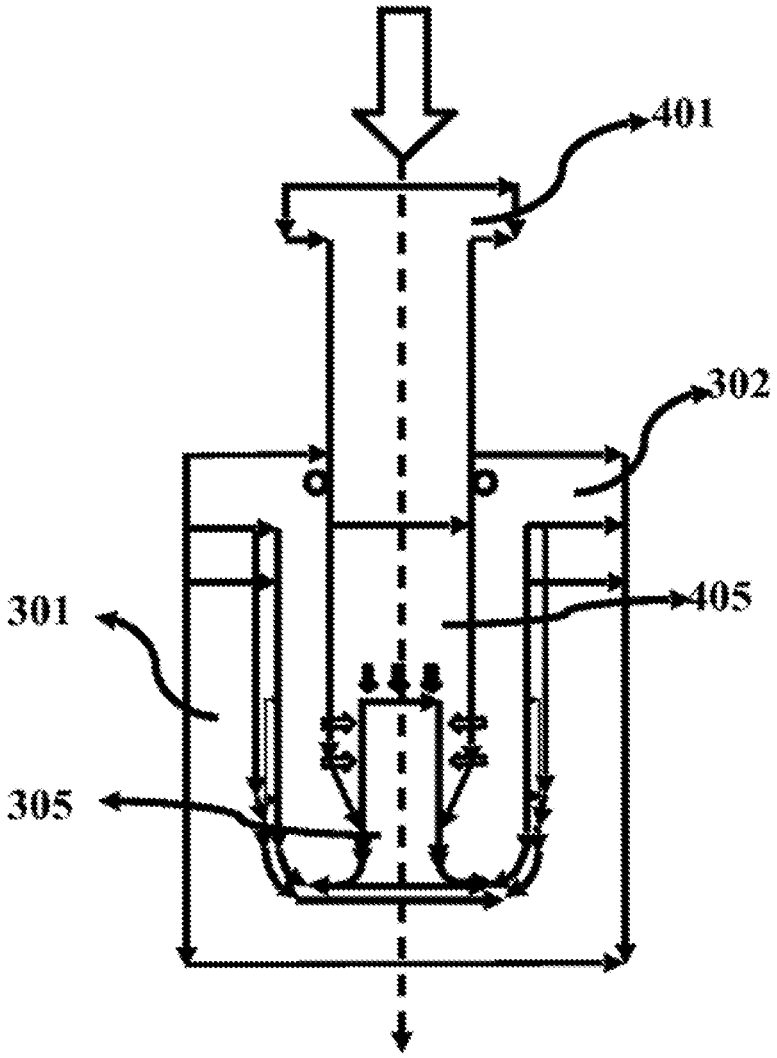
FIG. 4*c* illustrates a side sectional view of a hydrostatic backward extrusion system while compressing a billet, according to an embodiment herein.

FIG. 4*c* illustrates a side sectional view of a hydrostatic backward extrusion system while compressing a billet, according to an embodiment herein. With respect to FIG. 4*b*, the plunger 401 is moved down to create a pressure on the high pressure fluid 405. The hydrostatic pressure compresses the billet 305 against the container 301 and forces the billet material 305 to flow into an annular space between the height of edge of the fix-punch 302 and the container 301. The billet material 305 flows through the annular space in a direction opposite to the fix-punch 302 and forms an extruded product.

Figure 4D:
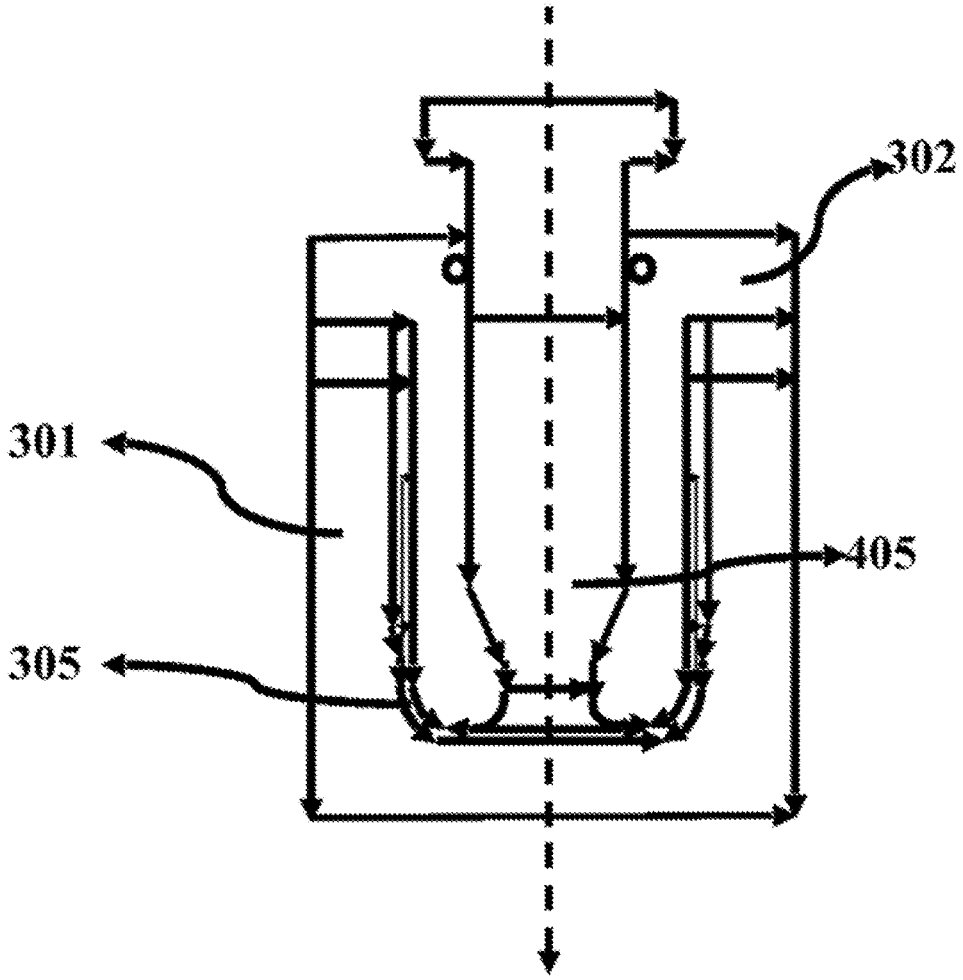
FIG. 4*d* illustrates a side sectional view of a hydrostatic backward extrusion system after forming an extruded product, according to an embodiment herein.

FIG. 4*d* illustrates a side sectional view of a hydrostatic backward extrusion system after forming an extruded product, according to an embodiment herein. With respect to FIG. 4*d*, the high pressure fluid 405 creates a hydrostatic pressure inside the billet chamber 304 and forces the billet material 305 to flow into the annular space between the edge height of the fix-punch 302 and the container 301. After the manufacturing process, the fix-punch 302 is removed and the extruded product is collected from the container 301.

Figure 5A:
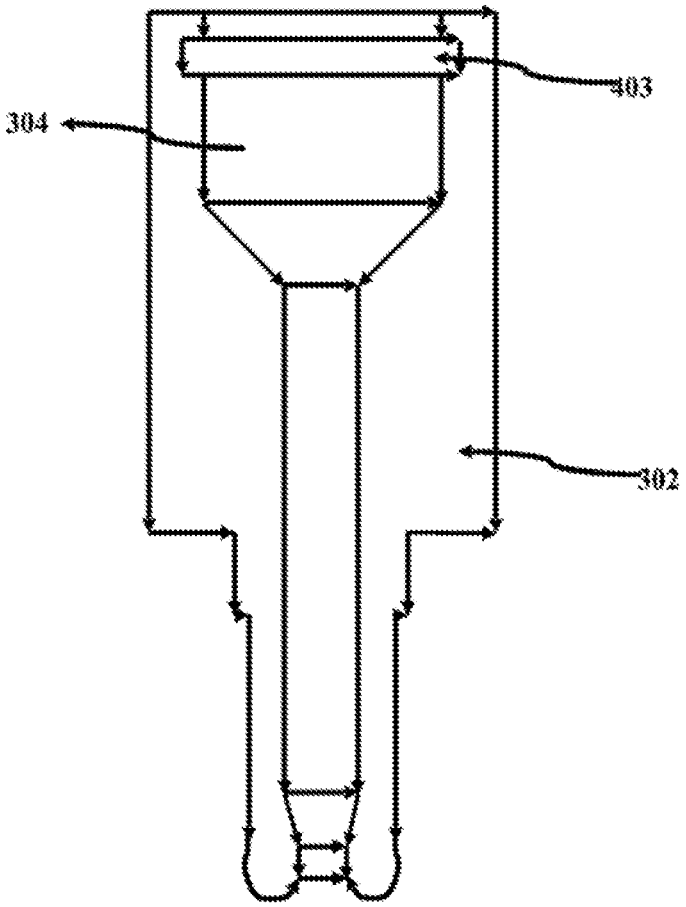
FIG. 5*a* illustrates a side sectional view of a fix-punch in a hydrostatic backward extrusion system, according to an embodiment herein.

FIG. 5*a* illustrates a side sectional view of a fix-punch in a hydrostatic backward extrusion system, according to an embodiment herein. with respect to FIG. 5*a*, the fix-punch 302 in the hydrostatic backward extrusion system comprises billet chamber 304, and first sealing location 403. The billet material is placed inside the billet chamber 304. A plunger is placed used to create hydrostatic pressure inside the billet chamber 304. The first sealing location 403 is arranged between the plunger and the fix-punch 302 to prevent leakage of the high pressure fluid during the extrusion process. A pair of O-rings are arranged to provide a seal in the first sealing location 403.

Figure 5B:
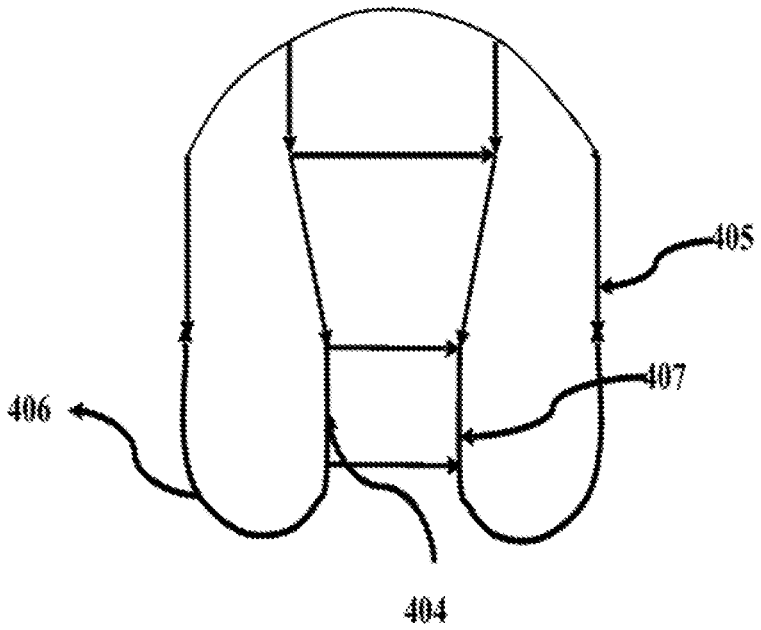
FIG. 5*b* illustrates an enlarged view of the two edge parts of a fix-punch in a hydrostatic backward extrusion system, according to an embodiment herein.

FIG. 5*b* illustrates an enlarged view of the two edge parts of a fix-punch in a hydrostatic backward extrusion system, according to an embodiment herein. With respect to FIG. 5*b*, the enlarged view of a part of a fix punch comprises edge height 409 of the fix-punch, outer radius 406, inner radius 407, and second sealing location 404. The design of the inner radius 407 of the fix-punch allows the billet material to flow freely into the annular space between the fix-punch and the container. The design of outer radius 406 of the fix-punch improves the flow of billet material during the hydrostatic extrusion process. In the bottom of the fix-punch, the second sealing location 404 is arranged between the billet and the surrounding high pressure fluid to prevent the leakage of the high pressure fluid during the extrusion process. At the second sealing location 404, the diameter of the billet chamber is smaller than the diameter of the billet.

Figure 6A:
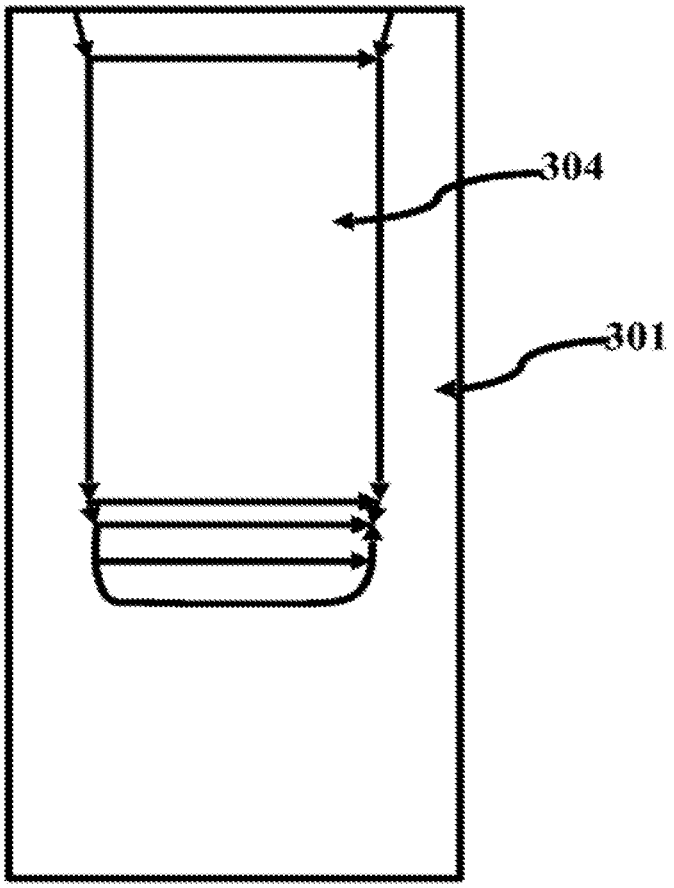
FIG. 6*a* illustrates a side view of a container in a hydrostatic backward extrusion system, according to an embodiment herein.

FIG. 6*a* illustrates a side view of a container in a hydrostatic backward extrusion system, according to an embodiment herein. With respect to FIG. 6*a*, the container 301 is completely closed at one end. The billet chamber 304 is formed inside the container 301 to house the fixed punch and the billet material. The parameters of the container 301 comprises radius and edge height of the container 301.

Figure 6B:
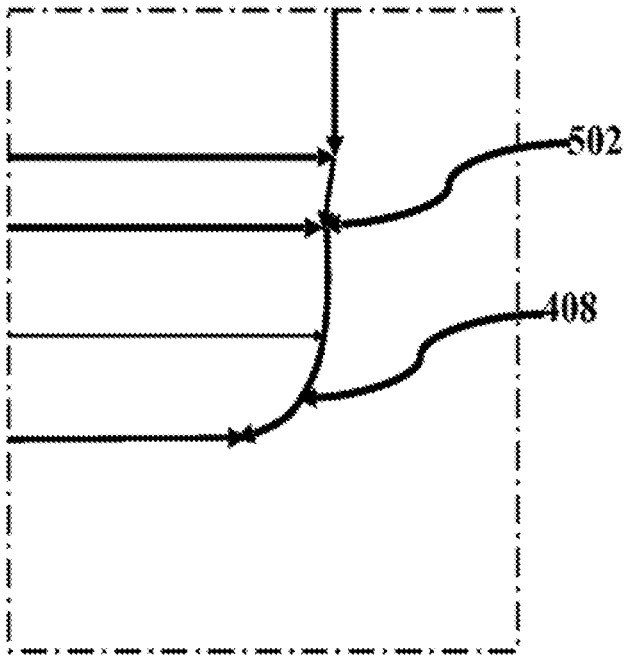
FIG. 6*b* illustrates a partially enlarged view of part of a container in a hydrostatic backward extrusion system, according to an embodiment herein.

FIG. 6*b* illustrates a partially enlarged view of part of a container in a hydrostatic backward extrusion system, according to an embodiment herein. With respect to FIG. 6*b*, the parameters of container comprises radius 408 and edge height 502. The radius of the container 408 is selected such that the flow of billet material is improved during the hydrostatic extrusion process.

Figure 7:
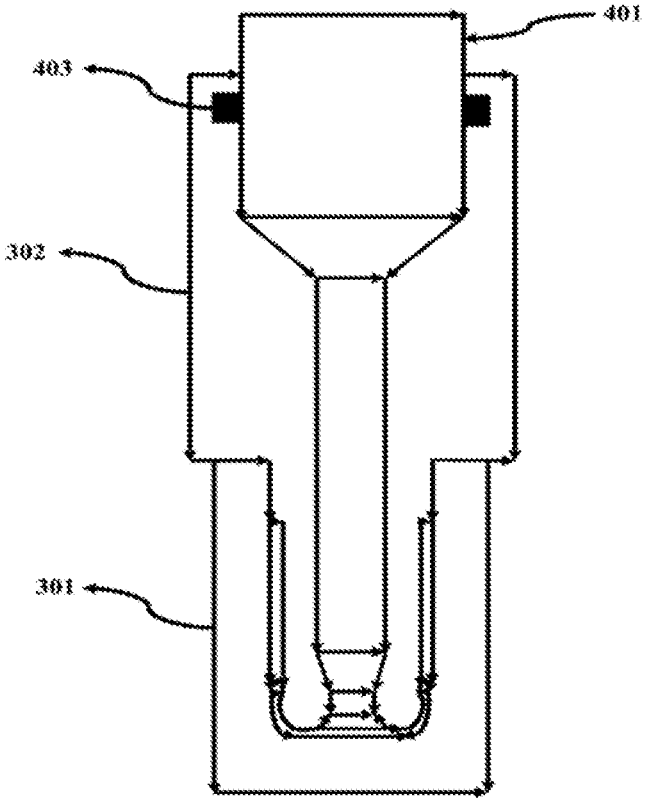
FIG. 7 illustrates a side view of a hydrostatic backward extrusion system with a mounted die, according to an embodiment herein.

FIG. 7 illustrates a side view of a hydrostatic backward extrusion system with a mounted die, according to an embodiment herein. With respect to FIG. 7, the hydrostatic backward extrusion system container 301, fix-punch 302, plunger 401, and the first sealing location 403. A hole in the fix-punch 302 forms the billet chamber. The billet material is placed inside the billet chamber. The head profile of the fix-punch 302 is arranged round in shape. The design of the head profile of the fix-punch 302 allows the billet material to flow smoothly into the annular space between the fixed punch 302 and the container 301. The first sealing location 403 is provided between the plunger 401 and the fix-punch 302 to prevent leakage of the high pressure fluid from the billet chamber. A pair of O-rings are used to provide seal in the first sealing location 403.

Figure 8:
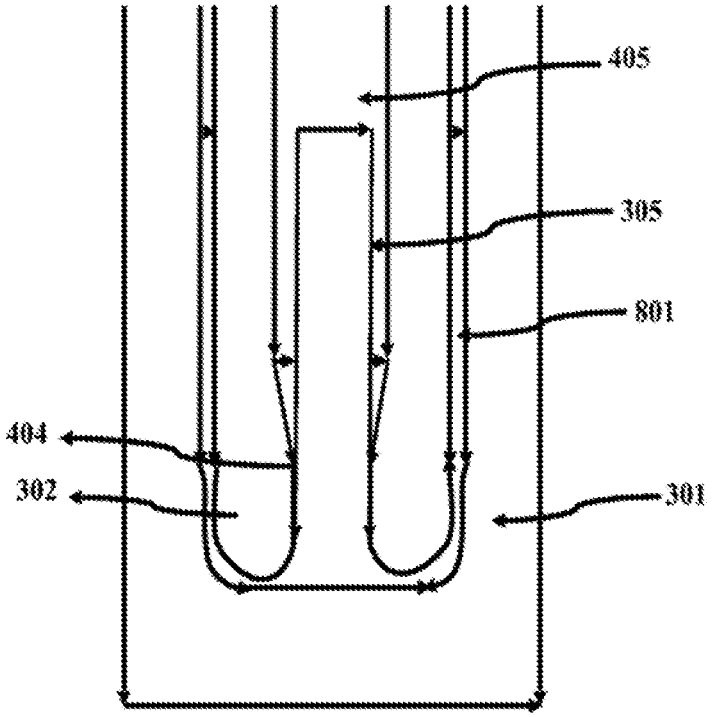
FIG. 8 illustrates a side sectional view of a hydrostatic backward extrusion system, according to an embodiment herein.

FIG. 8 illustrates a side sectional view of a hydrostatic backward extrusion system, according to an embodiment herein. With respect to FIG. 8, the hydrostatic backward extrusion system comprises container 301, fix punch 302, billet material 305, second sealing location 404, high pressure fluid 405, and material flow 801. A billet chamber is designed in the fix-punch 302. The billet material 305 is placed inside the billet chamber. The inner diameter of the billet chamber is arranged to be more than the billet 305 diameter. The empty space between the billet chamber and the billet material 305 is filled with the high pressure fluid 405. The high pressure fluid 405 prevents the contact of billet material 305 with the fix-punch 302 or die. In the bottom of the fix-punch 302, the second sealing location 404 is provided between the billet 305 and the surrounding high pressure fluid 405. The seal prevents the leakage of the high pressure fluid 405 during the extrusion process. Due to hydrostatic pressure, the billet material 305 flows into the annular space between the container 301 and the fix-punch 302.

Figure 9:
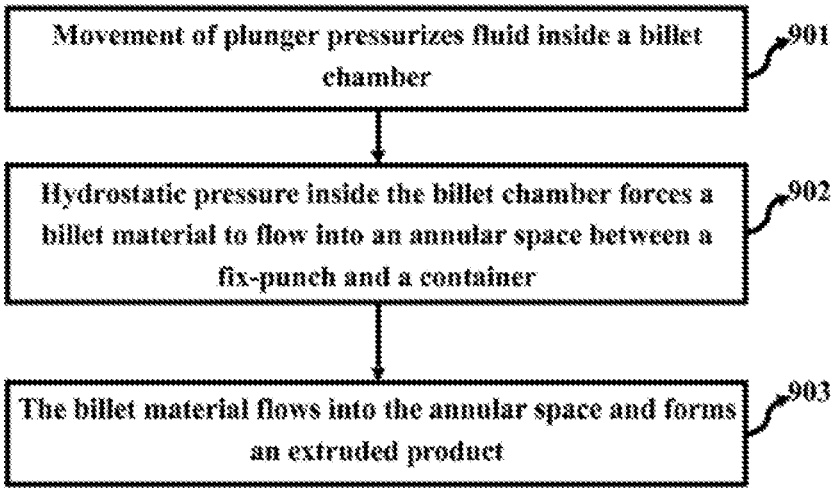
FIG. 9 illustrates a flowchart explaining a method of producing an extruded product using a hydrostatic backward extrusion system, according to an embodiment herein.

FIG. 9 illustrates a flowchart explaining a method of producing an extruded product using a hydrostatic backward extrusion system, according to an embodiment herein. With respect to FIG. 9, the plunger is placed inside the billet chamber and moved forward to pressurize high pressure fluid inside (901). The hydrostatic pressure inside the billet chamber compresses the billet material against the container and forces the billet material to flow into an annular space between the edge height of the fix-punch and the container (902). The billet material flows into the annular space and forms an extruded product (903).

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

Although the embodiments herein are described with various specific embodiments, it will be obvious for a person skilled in the art to practice the invention with modifications. However, all such modifications are deemed to be within the scope of the claims.

It is also to be understood that the following claims are intended to cover all of the generic and specific features of the embodiments described herein and all the statements of the scope of the embodiments which as a matter of language might be said to fall there between.

What is claimed is:

1. A hydrostatic backward extrusion system comprising:

a container;

a fixed-punch arranged inside the container, and wherein the fixed punch comprises a billet chamber to house a billet material, and wherein the fixed-punch is placed inside the container to form a gap between the fixed-punch and the container to form a die located on an outside of the fixed punch between the fixed-punch and the container, and wherein the billet material in the billet chamber is surrounded by a fluid;

a plunger, and wherein the plunger is placed at a top of the billet chamber, wherein the plunger is configured to move into the billet chamber to extrude the billet material through the die;

a first sealing location provided between the plunger and the fixed-punch to prevent a leakage of the fluid from the billet chamber, and wherein a diameter of the billet chamber in the first sealing location is larger than a diameter of the billet material;

a second sealing location arranged at a bottom of the fixed-punch between the billet material and the surrounding fluid to prevent a leakage of the fluid during an extrusion process, and wherein a diameter of the billet chamber in the second sealing location is smaller than the diameter of the billet material.

2. The system according to claim 1, wherein the plunger is moved forward in the billet chamber to generate a hydrostatic pressure on the fluid, and wherein the generated hydrostatic pressure forces the billet material to flow into the gap between the container and the fixed-punch.

3. The system according to claim 1, wherein the fixed punch has a head profile and wherein the head profile of the fixed-punch is arranged round in shape and wherein the head profile of the fixed-punch allows the billet material to flow into the gap between the fixed punch and the container.

4. The system according to claim 1, wherein the surrounding fluid prevents a contact of the billet material with the fixed-punch inside the billet chamber.

5. The system according to claim 1 further comprises a plurality of O-rings provided in the first sealing location to seal the plunger with the fixed-punch.

6. The system according to claim 1, wherein an optimum diameter value of the diameter of the billet chamber at the second sealing location is estimated using a finite element analysis.

7. The system according to claim 1, wherein a diameter value of the plunger is selected to move the plunger in the billet chamber to produce an extruded product with a desired length.

8. The system according to claim 1, wherein the fluid filled in the billet chamber is castor oil.

9. The system according to claim 1, wherein the container has an edge with a preset height, wherein the preset edge height of the container is selected such that an edge height of an edge of the fixed-punch and the edge height of the container are positioned in front of each other at a same level such that after the billet material passes through the edges, contact between the billet material and the container and the fixed punch is eliminated.

10. The system according to claim 1, wherein the system is configured to produce an extruded product that has homogenous properties.

* * * * *